US006450723B1

(12) United States Patent
Lithgow

(10) Patent No.: US 6,450,723 B1
(45) Date of Patent: Sep. 17, 2002

(54) DRYWALL JOINT COMPOUND APPLICATOR TOOL

(76) Inventor: Kevin J. Lithgow, 4725 Lyndale Ave., Minneapolis, MN (US) 55409

( * ) Notice: Subject to any disclaimer, the term of this patent is extended or adjusted under 35 U.S.C. 154(b) by 0 days.

(21) Appl. No.: 10/042,654

(22) Filed: Jan. 8, 2002

Related U.S. Application Data

(60) Provisional application No. 60/271,009, filed on Feb. 26, 2001.

(51) Int. Cl.[7] ..... B05C 11/00

(52) U.S. Cl. ..... 401/266; 401/139; 425/87; 222/566

(58) Field of Search ..... 401/266, 265, 401/261, 139, 137, 130, 9; 222/566, 567, 575; 425/87, 458; 15/235.7

(56) References Cited

U.S. PATENT DOCUMENTS 4,570,834 A * 2/1986 Ward ..... 222/566
5,017,113 A * 5/1991 Heaton et al. ..... 222/327
5,695,788 A * 12/1997 Woods ..... 15/235.7
5,749,498 A * 5/1998 Lavoie et al. ..... 222/192
5,775,551 A * 7/1998 Tordsen ..... 222/567
5,882,133 A * 3/1999 Chao et al. ..... 401/193

* cited by examiner

*Primary Examiner*—Timothy L. Maust
*Assistant Examiner*—Huyen Le
(74) *Attorney, Agent, or Firm*—Gray, Plant, Mooty, Mooty & Bennett, P.A.

(57) ABSTRACT

A tool for the application of joint compound to a corner joint formed at the intersection of two drywall panels during new construction, preparatory to finishing the corner. The corner can have an obtuse angle. The tool has a generally flat top surface with leading edges that converge toward an apex. A housing on the top surface is in spaced relationship from the leading edges and includes a chamber for receipt of joint compound from a pressurized source. The housing has discharge ports that are forwardly directed. In use the head is positioned in the corner and tilted in the direction so that the discharge ports face the corner. The head is tilted to an extent as may be necessary to cause the leading edges to engage the adjacent walls forming the corner. In this position, the head is drawn along the corner as the joint compound is discharged into the corner vicinity and is troweled by the leading edges.

11 Claims, 2 Drawing Sheets

DRYWALL JOINT COMPOUND APPLICATOR TOOL

CROSS REFERENCE TO RELATED APPLICATION

This application claims the benefit of U.S. Provisional Patent Application Serial No. 60/271,009 filed Feb. 26, 2001.

BACKGROUND OF THE INVENTION

In new housing construction, drywall panels are predominately used for interior walls. Seams and corners where panels meet require finishing with tape or equivalent product, and drywall joint compound. Interior corners in particular can be problematic. Typically, joint compound, also called mud, is applied to the corner vicinity and a corner-finishing product is applied over it. Several such finishing products are available for use, such as a product known as straight-flex, or paper tape, or the like.

Typically the interior corner vicinity is prepared for the receipt of such a product with a prior application of joint compound. The joint compound is applied using pressure-operated equipment that feeds joint compound under pressure to an applicator tool. An example of such pressure equipment is shown in U.S. Pat. No. 5,878,925 to Denkins et al issued Mar. 9, 1999. An example of a prior art applicator tool is a rigid block design with a square exterior corner that fits into the 90° interior corner. The mud applying surfaces have openings for discharge of mud onto adjacent corner surfaces of the drywall panels. The usefulness of this applicator tool diminishes greatly in direct proportion to the variance of the corner from 90°. Yet frequently for aesthetic or other reasons, a corner is formed that is much greater than 90°.

SUMMARY OF THE INVENTION

The present invention comprises a tool for the application of joint compound or mud, derived from pressure equipment, to interior corners during drywall installation. The tool can be used in conjunction with pressure equipment such as that shown in U.S. Pat. No. 5,878,925. The tool has a diamond shaped head that is relatively low in profile. The head has two leading edges substantially perpendicular to one another. The head has a flat bottom surface and a top surface that joins the bottom surface at the head edges. The top surface slopes away from the bottom surface forming a housing having an interior chamber for receipt of joint compound under pressure from the supply equipment. Front facing discharge openings or ports are located on the housing a short distance aft of the leading edges. The aft section of the head has a neck that connects to a flexible hose connector that in turn connects to the pressurized mud supply.

The tool head has a flat profile shaped to fit into an interior corner that is 90° or greater. In preparation for applying mud to the corner, the head is placed against the corner and tilted. One of the leading edges of the head confronts each wall. The tool is tilted in a direction so that the discharge ports face the corner. The tool is tilted to a degree necessary so that the leading edges engage the walls adjacent to the corner. The greater the angle between the walls, the greater the amount of tilt on the head in order that the leading edges engage the adjacent walls. Compound is discharged to the corner vicinity and troweled by the leading edges as the tool is moved along the corner.

The head is attached to the pressure equipment by a flexible hose segment to facilitate manipulating the head in corners. The hose segment can have a coil spring wrapped about it to maintain preferred resiliency.

IN THE DRAWINGS

DESCRIPTION OF A PREFERRED EMBODIMENT

Figure 1:
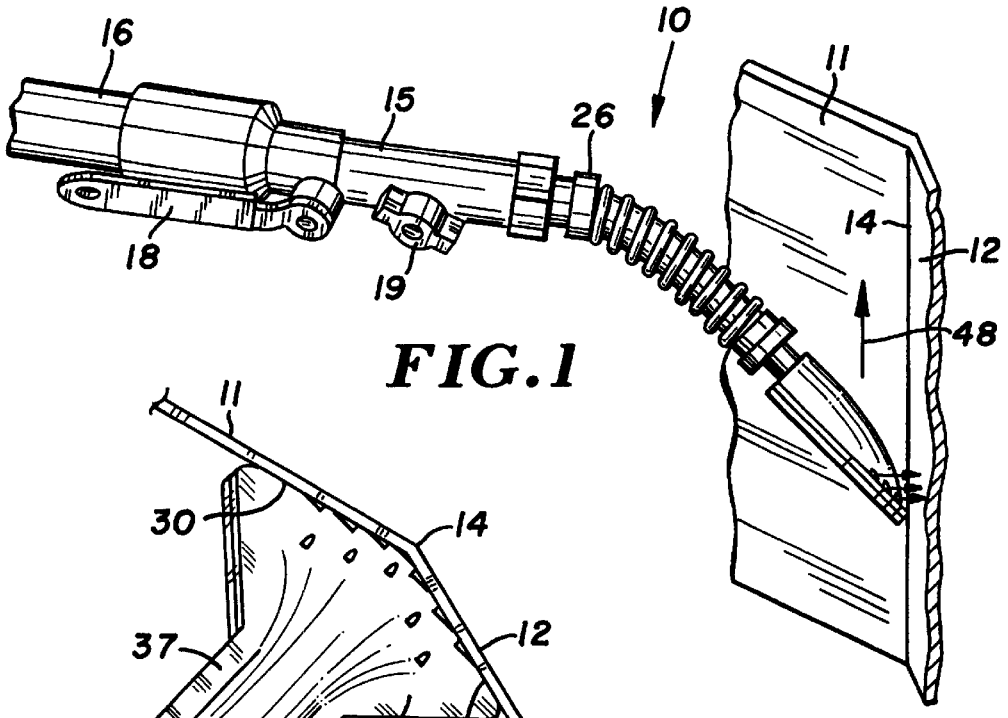
FIG. 1 is a side view of an applicator tool according to the invention shown poised and in use with respect to an obtuse corner formed by two drywall panels.

Referring to the drawings, there is shown in FIG. 1 a corner applicator tool according to the present invention indicated generally at 10. Applicator tool 10 is poised with respect to a corner 14 formed by dry wall panels 11, 12. The corner 14 can be an obtuse angle. The tool 10 is poised to apply a layer of joint compound to the corner 14 preparatory to the installation of other structural material in order to form a smooth and continuous joint.

Applicator tool 10 is connected to a handle 15 which is in turn connected to a transport tube 16 that feeds joint compound under pressure from a supply station (not shown). Transport tube 16 has a fill valve 18. Handle 15 has an open/close valve 19.

Figure 3:
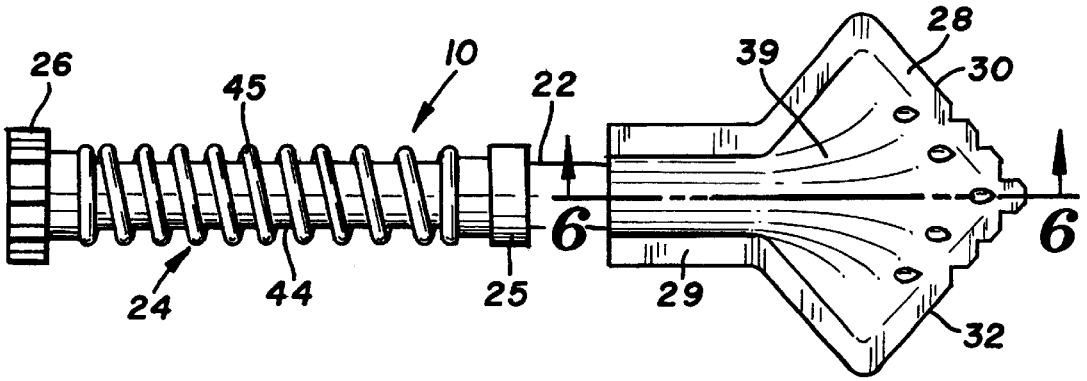
FIG. 3 is a top plan view of the applicator tool of FIG. 1.

As shown in FIG. 3, the applicator tool 10 includes a head 21 connected to a neck 22 and then to a body section 24 separated from the neck 22 by a shoulder 25. A hose type connector 26 is equipped with screw threads in order to attach to the end of the handle 15.

Figure 5:
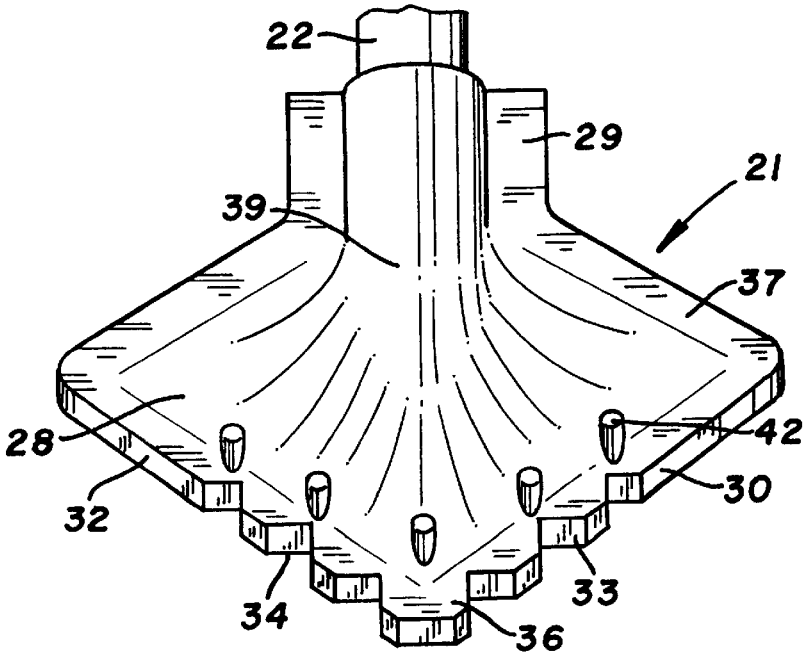
FIG. 5 is a front perspective view of the head of the applicator tool of FIG. 1.

Referring to FIGS. 3 and 5, the head 21 has a generally diamond shaped forward section 28 with first and second leading edges 30, 32 that are arranged in generally perpendicular relationship. The head 21 has a straight aft section 29 that connects to the neck 22. The leading edge 30 has a serrated or saw-toothed section 33 at the forward end thereof. The second leading edge 32 has a complimentary serrated or saw-toothed section 34 at the forward end thereof. The serrated sections 33, 34 meet at a forward rectangular apex 36.

Figure 4:
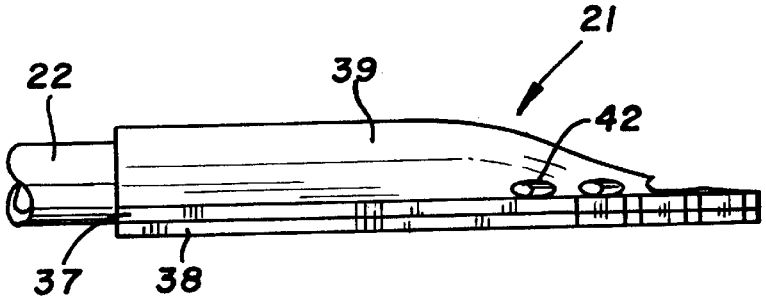
FIG. 4 is a side elevational view of the head of the applicator tool of FIG. 1.
Figure 6:
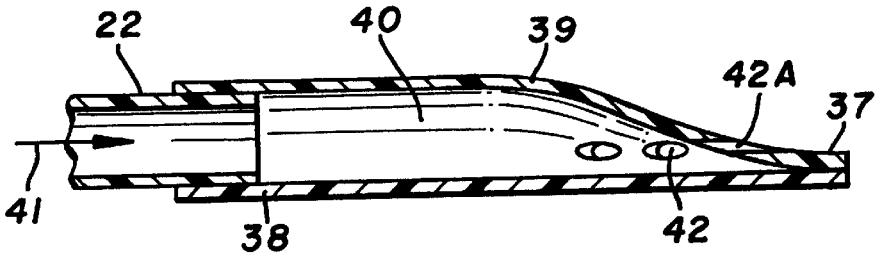
FIG. 6 is an enlarged sectional view of the head of the applicator tool of FIG. 3 taken along the line 6—6 thereof.

FIGS. 4 and 6 show that the head 21 is formed of a top wall 37 and a bottom wall 38. Head 21 can be formed of any suitable material such as plastic or rubber. It can be rigid or slightly flexible. For example, it can be made of metal such as a thin stainless steel, which is durable and resistant to corrosion.

Bottom wall 38 is flat. The perimeter edges of top wall 37 are also flat and join bottom wall 38. Centrally, the top wall 37 slopes upwardly and rearwardly from the leading edges 30, 32 forming a housing 39 that defines an interior chamber or manifold 40 for receipt of mud preparatory to application. Housing 39 connects with neck 22. A passage 41 (FIG. 6) leads from transport tube 16 to chamber 40.

Housing 39 is set back from or spaced inwardly and rearwardly of the leading edges 30, 32. Housing 39 has a plurality of discharge ports 42 that are open to chamber 40. Discharge ports 42 are located along the forward facing extremity of housing 39. As shown, one discharge port 42A faces straight ahead, and the other ports 42 are located aft thereof generally in coplanar relationship.

Referring again to FIGS. 1 and 3, body 24 is formed of a flexible hose-like segment 44. Section 44 is flexible in order to permit manipulation of the head 21 into corners. A resilient spring element comprised as a coil spring 45 engages the tubular section 44 bearing between connector 26 at one end and shoulder 25 at the other. Spring 45 limits the flexibility of the tubular section 44 and tends to return it to an undeflected position.

In use, the applicator tool 10 is assembled to a source of joint compound under pressure which, in the drawings, is shown as a joint compound transport tube 16 connected to a handle 15. The tube 16 is connected to suitable joint compound equipment such as the apparatus shown in U.S. Pat. No. 5,878,925. The open/close valve 19 is manipulated to supply joint compound to the applicator tool 10.

Figure 2:
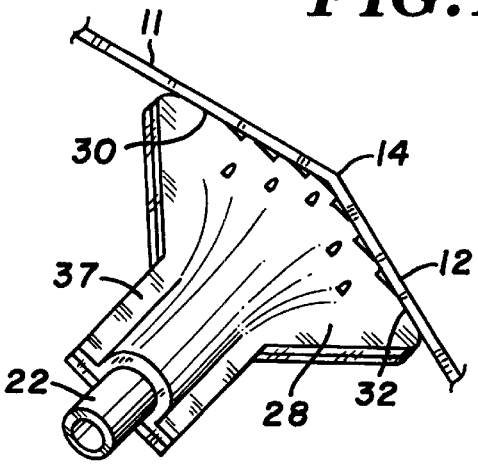
FIG. 2 is a top view of a portion of the tool and drywall panel corner shown in FIG. 1.

The applicator tool 10 is positioned in a corner 14 formed by two dry wall panels 11, 12. The tool is positioned in the orientation shown in FIGS. 1 and 2, such that the ports 42 face the drywall surface. The tool is tilted to an extent that the leading edges 30, 32 engage the surfaces of the drywall panels 11, 12, as shown in FIG. 2. If the drywall panels 11, 12 are perpendicular, the tool is brought into a perpendicular relationship with the panels, since the leading edges 30, 32 are perpendicular. For an obtuse angle between the abutting drywall panels, the tool 10 is tilted as shown in shown in FIG. 1. The tool is inclined with the ports facing the drywall panels as previously described. In such a position, the valve 19 is opened and joint compound is discharged through the ports 42. As the joint compound is discharged, the tool is moved along the corner as indicated by the arrow 48 in FIG. 1. The joint compound is troweled by the leading edges 30, 32.

The saw-toothed sections 33, 34 on the leading edges form grooves in the applied joint compound which leads to better adherence of the subsequently applied finishing product. The end tooth 36 fills gaps in the seam of corner 14 following construction.

While there has been shown and described a preferred embodiment of an applicator tool according to the invention, those skilled in the art will realize that deviations can be had from the embodiment shown without departing from the scope and spirit of the invention.

What is claimed is:

1. A drywall compound applicator tool for the application of drywall compound to a drywall corner joint vicinity, comprising:

a flexible tool body connectable at a first end to a supply source of joint compound under pressure;

an applicator head connected to a second end of the tool body;

said head having a base with first and second leading edges converging toward a forward apex, and a top wall with flat peripheral edge surfaces;

a housing connected to the top wall spaced inward from the first and second leading edges;

said housing defining a chamber for receipt of drywall compound;

a plurality of forward facing discharge ports in the housing open to the chamber;

said chamber connected to said tool body by a passageway for passage of joint compound from a supply source through the discharge ports to a corner joint vicinity.

2. The applicator of claim 1 including:

a saw-toothed edge on the first and second leading edges.

3. The applicator tool of claim 1 wherein:

said tool body includes a flexible hose segment and a spring connected to the hose segment tending to return the hose segment from a deflected position to an un-deflected position.

4. The applicator tool of claim 3 wherein:

said spring is a coil spring wrapped around the hose segment.

5. The applicator tool of claim 4 including:

a saw-toothed edge on the first and second leading edges.

6. The applicator tool of claim 1 wherein:

the base has a diamond-shaped forward section.

7. The applicator tool of claim 6 including:

a saw-toothed edge on the first and second leading edges.

8. The applicator tool of claim 7 wherein:

said base includes a flat bottom wall.

9. The applicator tool of claim 8 wherein:

said tool body includes a flexible hose segment and a spring connected to the hose segment tending to return the hose segment from a deflected position to an un-deflected position.

10. The applicator tool of claim 9 wherein:

said spring is a coil spring wrapped around the hose segment.

11. The applicator tool of claim 6 wherein:

the base has a straight trailing section connected to the diamond-shaped forward section.

* * * * *